US006182477B1

(12) United States Patent
Shibata et al.

(10) Patent No.: US 6,182,477 B1
(45) Date of Patent: Feb. 6, 2001

(54) METHOD OF AND APPARATUS FOR CONTROLLING AN ELECTRONIC PATTERN CIRCULAR KNITTING MACHINE

(75) Inventors: Takao Shibata, Osaka; Yoshihiro Aramaki, Hyogo, both of (JP)

(73) Assignee: Precision Fukuhara Works, Ltd. (JP)

( * ) Notice: Under 35 U.S.C. 154(b), the term of this patent shall be extended for 0 days.

(21) Appl. No.: 09/570,720

(22) Filed: May 15, 2000

(30) Foreign Application Priority Data

May 17, 1999 (JP) ..... 11-135640

(51) Int. Cl.[7] ..... D04B 15/78
(52) U.S. Cl. ..... 66/232; 700/141
(58) Field of Search ..... 66/231, 232, 237, 66/13, 19, 218; 700/141

(56) References Cited

U.S. PATENT DOCUMENTS 3,820,082 * 6/1974 Bauknecht et al. ..... 364/470.12
4,587,812 * 5/1986 Brega ..... 66/232
4,698,987 * 10/1987 Brega ..... 66/232
5,144,818 * 9/1992 Brandani ..... 66/219
5,186,028 * 2/1993 Kawase et al. ..... 66/232
5,862,682 * 1/1999 Maenaka et al. ..... 66/75.2
6,119,492 * 9/2000 Plath ..... 66/232

FOREIGN PATENT DOCUMENTS

10298857 * 4/1997 (JP) ..... 66/232

* cited by examiner

*Primary Examiner*—Danny Worrell
(74) *Attorney, Agent, or Firm*—Alston & Bird LLP

(57) ABSTRACT

An electronic pattern circular knitting machine and method are provided in which a first encoder is operatively associated with the needle cylinder with which it rotates synchronously and generates a pulse signal for each knitting needle and transmits that signal to a central controller for the knitting machine, in which is stored a datum position for the first encoder, for comparison with pre-stored pattern data to calculate the position of each knitting needle; in which a second encoder is operatively associated with a dial and its cam system, the movement of which changes the knitting timing, for generation and transmission of a position signal to the central controller for comparison with a stored corresponding position to the datum position of the first encoder and a determination of whether the knitting timing has been changed and if so, to adjust automatically the needle selection timing.

4 Claims, 3 Drawing Sheets

METHOD OF AND APPARATUS FOR CONTROLLING AN ELECTRONIC PATTERN CIRCULAR KNITTING MACHINE

FIELD OF THE INVENTION

The present invention relates to circular knitting machines and more particularly to a method of and apparatus for controlling an electronic pattern circular knitting machine.

BACKGROUND OF THE INVENTION

Electronic pattern circular knitting machines are currently in extensive use in the production of knitted fabrics of various designs from relatively simple to very complex. Typically, circular knitting machines include a rotatable needle cylinder having a multiplicity of grooves in the outer periphery parallel to the axis of rotation of the cylinder, each of which contains a knitting needle for reciprocation between a plurality of operative and inoperative positions. The rotatable needle cylinder cooperates with a rotatable, horizontal dial having a multiplicity of radial grooves in the upper surface thereof, each of which contains either a dial needle or a sinker depending on the type of knitting machine. The cylinder and dial are driven in rotation by a drive mechanism and the cylinder needles and dial needles or sinkers are moved past respective stationary cams which reciprocate the cylinder needles and dial needles or sinkers.

Since the cylinder needles and dial needles or sinkers cooperate in the knitting operation, the timing of the operation thereof is very important. Examples of such timing are synchronous and delayed. As knit patterns are changed, it is frequently necessary to change the knitting timing by changing the position of the needle cams. Of course, any change in the knitting timing must be correlated to the electronic pattern control and needle selection mechanism, which may be difficult and historically has been time consuming and expensive.

In Japanese Patent Provisional Publication No. 298857/1998 (Japanese Patent Application No. 113469 of 1997), it is proposed to employ an optical encoder associated with the needle cylinder for monitoring the position of each knitting needle and therefore determining changes in the timing of the needles by the cams associated with such knitting needles. While an improvement over conventional technology, this proposed arrangement has the disadvantage of only accommodating timing changes with respect to the knitting needles on the cylinder and therefore cannot accommodate timing changes with respect to dial needles or sinkers.

SUMMARY OF THE INVENTION

With the foregoing in mind, it is an object of the present invention to provide an electronic pattern circular knitting machine and method that automatically calculates the changed position of the dial corresponding to the needle cylinder when the knitting timing is changed.

This object is accomplished by providing an electronic pattern circular knitting machine having a controlling device for controlling the changing of the knitting timing, which device includes a first encoder operatively associated with the needle cylinder, a second encoder operatively associated with the dial, and transmission means connecting the first and second encoders, and by operating this electronic pattern circular knitting machine by initially determining the datum position of the first encoder for the knitting timing then in use and entering that datum position into the main controller for the circular knitting machine; and based on the entered datum position of the first encoder, entering the corresponding position of the second encoder into the main controller. Upon a change in the knitting timing, such as by moving the dial cam, the value of the moved position, outputted by the second encoder, is compared with the initial value stored in the main controller, and the comparison value is compared with the value of the first encoder monitoring the timing of each knitting needle on the needle cylinder and the resultant comparison is output to the needle-selection actuator to adjust automatically the needle-selection timing.

The method of the present invention further includes the following steps for each needle: determining whether the knitting timing position has been changed; if such timing has been changed, adjusting automatically the needle-selection timing on the basis of the comparison value as described above; if such timing has not been changed, determining whether the current timing is the cylinder-needle-selection timing; if so, outputting the cylinder-needle-selection data to the cylinder-needle-selection actuator; if the current timing is not the cylinder-needle-selection timing, then determining whether the current timing is the dial-needle-selection timing (or dial-sinker-selection timing); if so, then outputting the dial-needle-selection data to the dial-needle-selection actuator; and if the current timing is not the dial-needle-selection timing, returning to the first step and repeating these steps until the current timing is the dial-needle-selection timing.

BRIEF DESCRIPTION OF THE DRAWINGS

The foregoing and other objects and advantages of the invention, and the manner in which the same are accomplished, will be more readily understood when taken in conjunction with the accompanying detailed description and drawings in which.

DETAILED DESCRIPTION OF THE INVENTION

Figure 1:
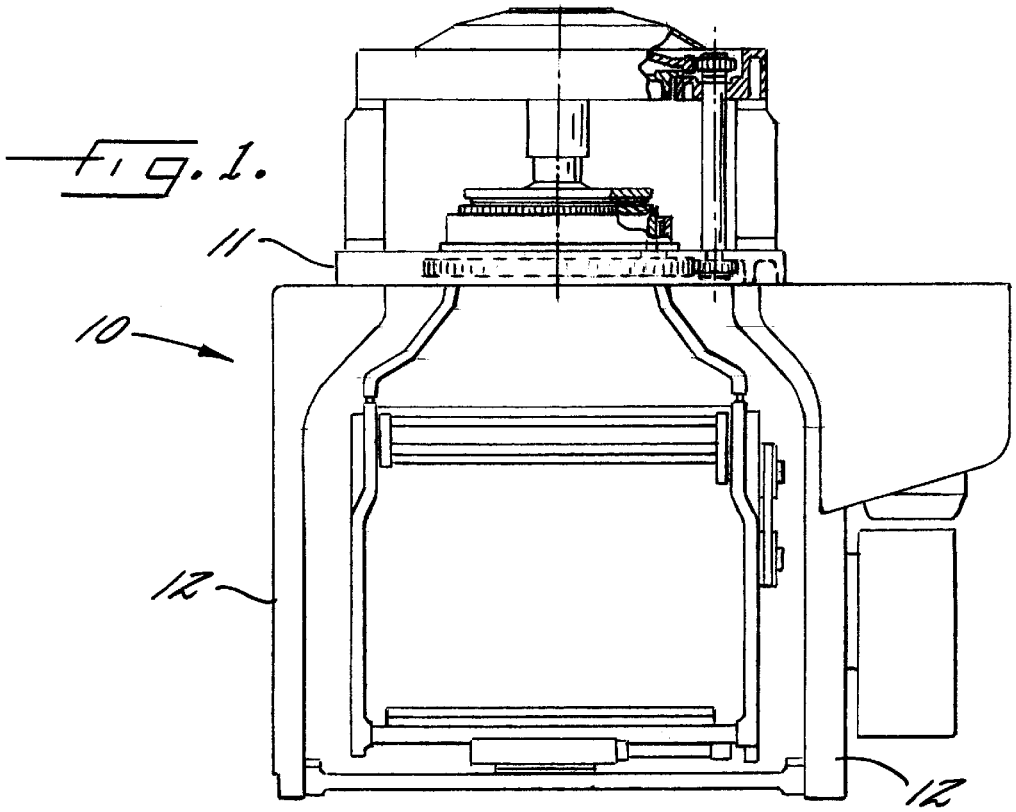
FIG. 1 is an elevational view of an electronic pattern circular knitting machine incorporating the present invention.
Figure 2:
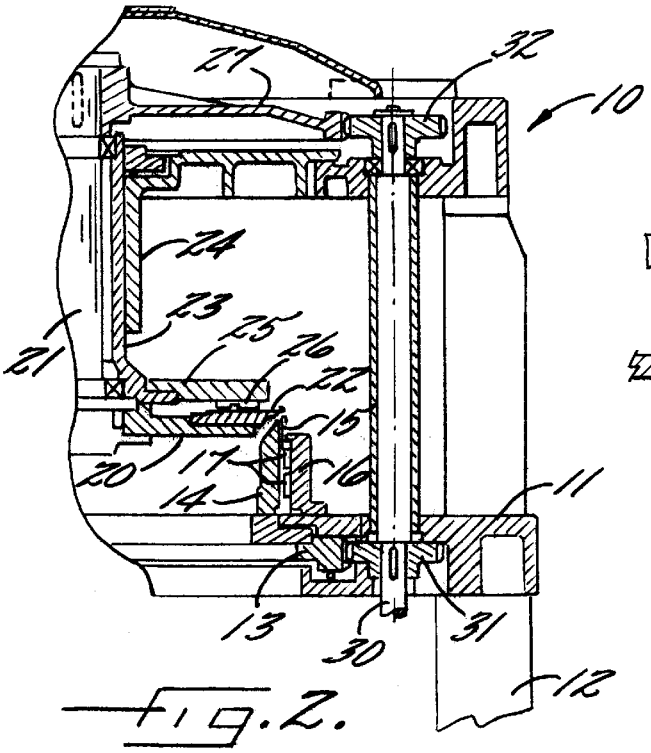
FIG. 2 is an enlarged, fragmentary sectional view of the upper right hand portion of the knitting machine shown in FIG. 1.

Referring now more specifically to the drawings, there is illustrated in FIG. 1, an electronic pattern circular knitting machine, generally referred to at 10. Knitting machine 10 includes a bed 11 supported by a plurality of legs 12. A lower gear wheel 13 (ring gear) is rotatably mounted on bed 11 by suitable bearings (not shown) and mounts for rotation therewith a needle cylinder 14 (FIG. 2). Needle cylinder 14 has a multiplicity of vertical, spaced-apart grooves in the outer periphery thereof and a knitting needle 15 is slidably mounted in each such groove.

A cylinder cam block 16 is mounted on bed 11 adjacent the needle cylinder 14 and carries a plurality of cams 17 on the side thereof facing the needle cylinder 14. As cylinder 14 rotates, it carries the knitting needles 15 past the cams 17 where butts on the needles 15 engage the cams 17 to reciprocate the needles 15.

A needle dial 20 is rotatably mounted above and in operative association with the needle cylinder 11 by an axle 21. Dial 20 has a multiplicity of radial spaced-apart grooves in the upper surface thereof. A dial needle 22 is slidably mounted in each such dial groove. It should be understood that the present invention, while being described in connection with a needle dial, is applicable to knitting machines having sinker dials. An internal cylinder 23 surrounds axle 21 and is telescopically received in an external cylinder 24. A dial cam block 25 is mounted on the lower end of internal cylinder 23 and carries dial cams 26 on the lower surface thereof in operative association with the dial needles 22.

An upper gear wheel 27 is mounted on the upper end of axle 21 for driving axle 21 and thus needle dial 20 in rotation. As with all knitting machines, knitting machine 10 includes a main drive motor (not shown) which is drivingly connected to a drive shaft 30 (FIG. 2). A lower pinion gear 31 is mounted on drive shaft 30 for rotation therewith and meshes with lower gear wheel 13 to rotate gear wheel 13 and thus needle cylinder 14. An upper pinion gear 32 is mounted on the upper end of drive shaft 30 for rotation therewith and meshes with upper gear wheel 27 to rotate gear wheel 27, axle 21 and dial 20. Accordingly, the needle cylinder 14 and dial 20 rotate synchronously when the main motor is operating.

Figure 7:
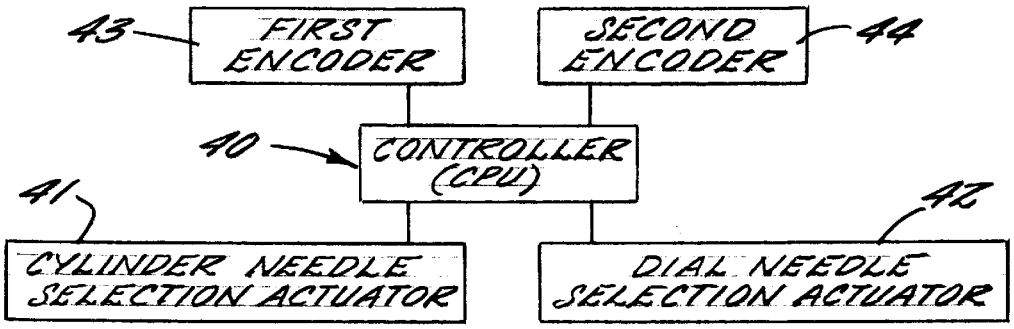
FIG. 7 is a schematic view showing a block diagram of the signal-transmission route of the present invention.

The knitting machine 10 includes a main electronic pattern controller (CPU); generally indicated at 40 (FIG. 7), as is well known in the knitting art. Controller 40 includes a memory in which pattern data and yarn-switching data are stored as part of a pre-set knitting pattern, a numeric key pad, a monitor, etc. (not shown). In addition to the controller 40, knitting machine 10 includes a cylinder needle selection actuator 41 and a dial needle selection actuator 42 for selecting and actuating the cylinder needles 15 and dial needles 22, respectively, in accordance with the knitting pattern then active.

Figure 3:
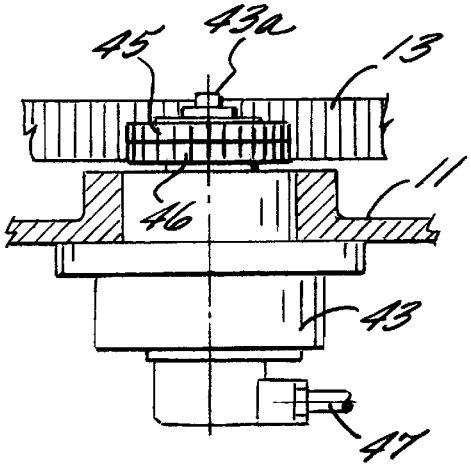
FIG. 3 is an enlarged, fragmentary sectional view of a portion of the bed, and ring gear of the knitting machine of FIG. 1 and showing the first encoder of the present invention.

A first encoder 43 (FIGS. 3 and 7) is provided for cylinder 14 and a second encoder 44 (FIGS. 4, 5 and 7) is provided for dial 20. Preferably, the encoders 43 and 44 are absolute type encoders, such as Model TRD-NA2048 NWE2486 made and sold by Koyo Electronics Industries Co., Ltd. (Kodaira-shi, Tokyo). This encoder inputs and outputs signals of absolute positions corresponding to rotational angles. Because of this characteristic, the encoders 43 and 44 do not require a counter, and as long as it is turned on, it generates a continuous output according to the angle of the input rotation axis.

The first encoder 43 is mounted on the bottom of bed 11 (FIG. 3) together with a datum sensor (not shown). Encoder 43 has a shank 43*a* on which are mounted double pinions 45, 46 for rotation therewith. Pinions 45, 46 have internal springs (not shown) biasing these pinions together so that no gap is formed therebetween and both pinions 45, 46 mesh with lower gear wheel 13. First encoder 43 is connected to the controller 40 by a cable 47.

Figure 4:
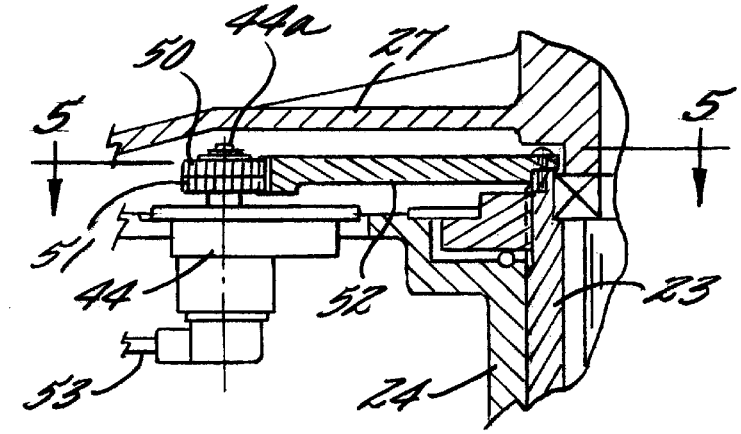
FIG. 4 is an enlarged fragmentary sectional view of a portion of the knitting machine of FIG. 1 showing the dial and second encoder of the present invention.
Figure 5:
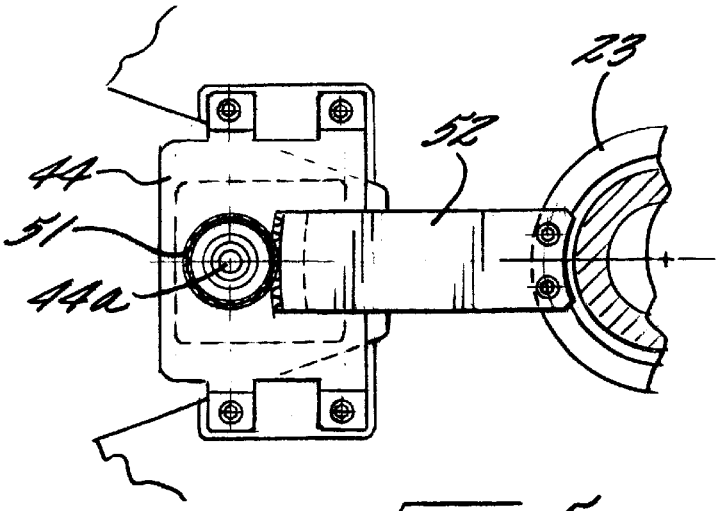
FIG. 5 is a fragmentary sectional view taken substantially along line 5.5 in FIG. 4.

The second encoder 44 is mounted on the upwardly widening portion of external cylinder 24 and includes a shank 44*a* on which are mounted double pinions 50, 51 for rotation therewith (FIGS. 4 and 5). Pinions 50, 51 have internal springs biasing the pinions 50, 51 together so that no gap is formed therebetween and mesh with a rack 52 carried by the internal cylinder 23. Second encoder 44 is connected to the controller 40 by a cable 53.

In setting the knitting timing, the first encoder 43 is adjusted initially by rotating the knitting machine to locate the datum position "0" using the datum sensor, the datum-detecting element (not shown) that is attached to lower gear wheel 13, and three LED lamps for datum adjustment (also not shown). When the datum position "0" is located, that position is entered into the controller 40 by means of the key pad on the control panel. The meshing of the pinions 45, 46 with the gear wheel 13 is then fine-tuned until two of the LED lamps are lit simultaneously which indicates that the datum position "0" of the first encoder 43 has been determined and established.

The second encoder 44 is then adjusted after the datum position "0" of the first encoder 43 has been determined by fine-tuning or fine-adjusting the meshing of the pinions 50, 51 with the rack 52. When one of the LED lamps for mesh adjustment is lit, the position of the second encoder 44 corresponding to the datum position "0" of the first encoder 43 is determined. When all of the LED lamps for datum adjustment, the LED lamps for mesh adjustment corresponding to pinions 45, 46 of first encoder 43 and the LED lamps for mesh adjustment corresponding to pinions 50, 51 of second encoder 44 are lit, the position of the second encoder 44 is stored in the memory of Controller 40.

The lower gear wheel 13 and pinions 45, 46 of the first encoder 43 rotate at the same speed ratio. Adjust any knitting needle 15 on the needle cylinder 14 to the datum position "0" of the knitting machine 10 and it will return to its original position after pinions 45, 46 of the first encoder 43 have rotated a dozen or so times. Because of this configuration, when the electronic pattern circular knitting machine 10 operates, the controller 40 can ascertain the rpm of the pinions 45, 46 from the output of the rotation angle of the first encoder 43, and in addition, can deduce the datum position "0" of the electronic pattern circular knitting machine 10 from the rpm.

The operation of the control means of the present invention will now be described. When the knitting machine 10 operates, the cylinder 14 and dial 20 rotate, as does lower gear wheel 13 causing first encoder 43 to generate a pulse signal synchronized with each knitting needle 15 as a needle sensor and to transmit this needle sensor signal by cable 47 to the controller 40. The controller 40 compares this signal with the pre-stored pattern data to calculate the position of the cylinder knitting needle 15. The calculated comparison value generates an actuator-activating signal, which is output to the cylinder needle selection actuator 41 or the dial needle selection actuator 42. At this time, the striper data is also compared and calculated to allow the yarns to be changed if required.

Figure 6A:
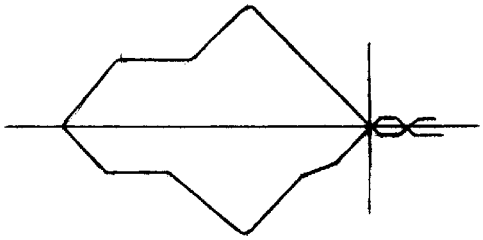
FIG. 6A is a schematic view of a synchronous timing diagram for the knitting machine of FIG. 1.
Figure 6B:
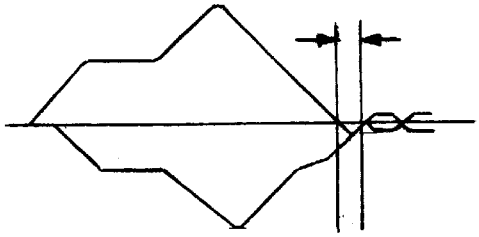
FIG. 6B is a schematic view of a delayed timing diagram for the knitting machine of FIG. 1.

When the knitting timing (i.e. the cam timing of the needle cylinder and the dial) is changed, such as, for example, a change from the synchronized cam timing shown in FIG. 6A to the delayed cam timing shown in FIG. 6B or vice versa, the dial cam 26 opposing the dial needles 22 moves over the distance "X" in FIG. 6B with respect to the cylinder cam 17 opposing the cylinder needles 15, and the dial cam 26 disengages.

The movement of dial cam 26 the distance "X" is output by the second encoder 44 to the controller 40 and is compared with the previously determined value when the position of the second encoder 44 was stored in the controller 40 during the initial setting or set-up, and this comparison value automatically adjusts the timing of the output to the dial needle selection actuator 42.

Figure 8:
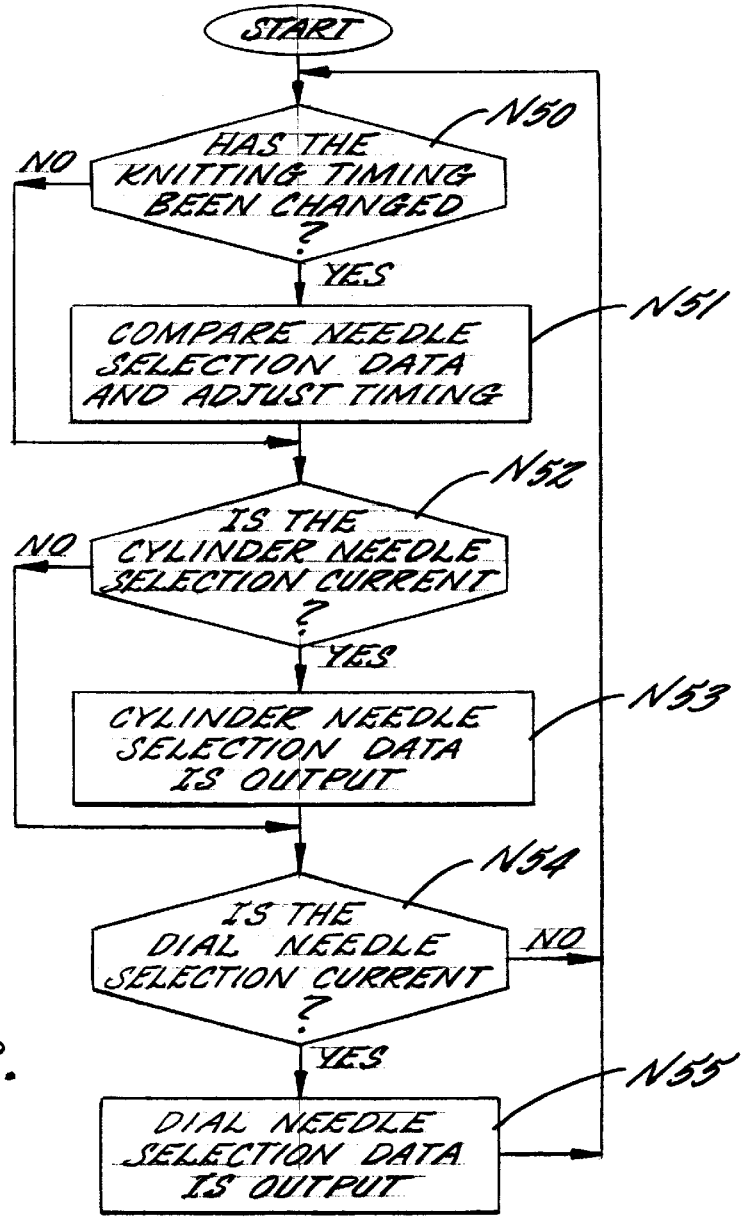
FIG. 8 is a schematic view of a flow chart showing the action of the controlling device of the present invention.

The method of operation of the electronic pattern circular knitting machine 10 will now be described with particular reference to the flow chart of FIG. 8. When the knitting machine 10 is started, the first step, indicated at N50, is to determine whether or not the knitting timing has been changed. This is accomplished by comparing the signals from the first and second encoders 43 and 44 with the pre-stored values from the initial set-up.

If the knitting timing is determined to have been changed, the value after the dial 20 has been moved is compared with the initial set-up value pre-stored. Then, the needle selection timing is automatically adjusted using this comparison value, indicated at N51.

If the knitting timing is determined not to have been changed by step N50, the step 51 is by-passed and a determination of whether or not the current timing in the cylinder needle timing is made, as indicated at N52. If so, the cylinder needle selection data is output to the cylinder needle selection actuator 41, as indicated at N53.

If the current timing is determined not to be the cylinder needle timing by step N52, step N53 is by-passed and a determination of whether or not the current timing in the dial needle selection timing is made, as indicated at N54. If so, the dial needle selection data is output to the dial needle selection actuator 42, as indicated at N55, and the process is repeated for each succeeding needle 15.

If the current timing is determined not to be the dial needle selection timing by step N54, the process returns to step N50 and repeats until the current timing becomes the dial needle selection timing.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. In an electronic pattern circular knitting machine having a rotatable needle cylinder, a multiplicity of knitting needles carried by said cylinder, cylinder cam means for operating said cylinder needles, a rotatable dial operatively associated with said cylinder, a multiplicity or dial knitting elements carried by said dial, dial cam means for operating said dial knitting elements, central pattern control means for storing knitting pattern data and for controlling the knitting operation of said knitting machine, cylinder needle selection actuating means for receiving cylinder needle selection data for said central control means and for selecting and actuating cylinder needles responsive thereto, and dial knitting element selection actuating means for receiving dial knitting element selection data from said central control means and for selecting and actuating said dial knitting elements responsive thereto, the improvement comprising means for controlling the knitting timing of said knitting machine comprising first encoding means operatively connected to said needle cylinder for rotation synchronously therewith and having a datum position entered and stored in said central control means, said first encoding means transmitting to said central control means a continuous pulse signal synchronized with each of said cylinder knitting needles for comparison with the pre-stored pattern data to calculate the position of each cylinder knitting needle, and second encoding means operatively connected to said dial and said first encoding means and having a corresponding position to the datum position of said first encoding means entered and stored in said central control means, said second encoding means monitoring the position of said dial cam means and thus sensing any change in the position of said dial cam means and transmitting to said central control means a pulse signal for comparison with the initial value of the position of said second encoding means corresponding to the datum position of said first encoding means for automatically adjusting the needle selection timing.

2. An electronic pattern circular knitting machine according to claim 1 wherein said first and second encoding means comprises absolute type encoders for generating and transmitting signals of absolute positions corresponding to rotational angles.

3. An electronic pattern knitting machine according to claim 2 wherein said first and second encoders include pinions and said first encoder pinion mesh with a gear wheel rotating said needle cylinder and said second encoder pinion meshes with a rack gear connected to said dial cam means.

4. A method of controlling the changing of the knitting timing in an electronic pattern circular knitting machine comprising (a) storing in a central controller a datum position for a first encoder operatively connected to a needle cylinder of the knitting machine, (b) establishing and storing in the central controller a corresponding position to the datum position of said first encoder of a second encoder operatively associated with a dial of the knitting machine, (c) causing the first encoder to generate and to transmit to said central controller a pulse signal synchronized with each knitting needle carried by the needle cylinder as a needle sensor as the needle cylinder rotates, (d) causing the second encoder to generate and transmit to said central controller a pulse signal as to the position of a dial cam, the movement of which changes the knitting timing, (e) determining whether the knitting timing position of the dial cam has been changed by comparing the pulse signal from the second encoder with the stored initial corresponding position, (f) if the knitting timing position of the dial cam is determined to have been changed, automatically adjusting the needle-selection timing of the knitting machine based on the comparison performed in the preceding steps, (g) if the knitting timing is determined not to have been changed, determining whether the current timing is the cylinder needle selection timing, (h) if so, outputting cylinder needle selection data to a cylinder needle selection actuator of the knitting machine, (i) if not, determining whether the current timing is the dial knitting element timing, (j) if so, dial knitting element selection data to a dial knitting element selection actuator of the knitting machine, (k) if not, returning to step (g) and repeating that step and subsequent steps hereof until the current timing is determined to be the dial knitting element selection timing, and (l) returning to step (g) and repeating that step and subsequent steps for each knitting needle.

* * * * *